US007001155B2

(12) United States Patent
Cabrales et al.

(10) Patent No.: US 7,001,155 B2
(45) Date of Patent: Feb. 21, 2006

(54) COMPRESSOR IMPELLER WITH STRESS RISER

(75) Inventors: Jose Cabrales, Mission Viejo, CA (US); Gerald Duane LaRue, Torrance, CA (US); John M. Wilson, Redondo Beach, CA (US); Angus Lemon, Anaheim, CA (US)

(73) Assignee: Honeywell International, Inc., Morristown, NJ (US)

( * ) Notice: Subject to any disclaimer, the term of this patent is extended or adjusted under 35 U.S.C. 154(b) by 175 days.

(21) Appl. No.: 10/439,075

(22) Filed: May 14, 2003

(65) Prior Publication Data

US 2004/0022648 A1 Feb. 5, 2004

Related U.S. Application Data

(60) Provisional application No. 60/400,015, filed on Jul. 30, 2002.

(51) Int. Cl.
*F04B 35/00* (2006.01)

(52) U.S. Cl. ..... 417/319; 417/405; 417/406; 417/407; 417/408; 417/409; 416/244 R; 416/204 R; 415/170.1; 415/230; 415/261.1

(58) Field of Classification Search ..... 417/405–409, 417/319; 416/244 R, 204 R; 415/170.1, 415/230, 261.1
See application file for complete search history.

(56) References Cited

U.S. PATENT DOCUMENTS 2,602,683 A * 7/1952 Aue ..... 403/259
2,795,371 A * 6/1957 Buchi, Sr. et al. ..... 416/171
3,874,824 A * 4/1975 Cronstedt et al. ..... 417/406
3,901,623 A * 8/1975 Grennan ..... 415/141
3,904,301 A * 9/1975 Schroeder ..... 403/259
3,914,067 A * 10/1975 Leto ..... 416/244 R
3,961,867 A * 6/1976 Woollenweber ..... 417/407
4,935,656 A * 6/1990 Kawamura ..... 310/156.08
4,986,733 A * 1/1991 Fleury et al. ..... 415/230
5,193,989 A * 3/1993 Fleury et al. ..... 417/407

* cited by examiner

*Primary Examiner*—Charles G. Freay
*Assistant Examiner*—Emmanuel Sayoc
(74) *Attorney, Agent, or Firm*—Chris James

(57) ABSTRACT

A compressor impeller for use with a boreless turbocharger is provided in accordance with this invention. The compressor impeller comprises an integral hub projecting axially therefrom that includes a partial bore therein that extends from an open to a close bore end. The bore includes a threaded portion that is configured to accommodate threaded engagement with an end of a common shaft disposed through a turbocharger housing and attached at an opposite end to a turbine wheel. The hub is specially configured so that the threaded portion has a relatively increased wall thickness when compared to a remaining portion of the bore disposed between the threaded portion and the end of the bore. The bore is configured providing a section having a reduced wall thickness, between the threaded portion and the bore closed end, for purposes of providing a preferential stress relief mechanism. Configured in this manner, the compressor impeller operates to ensure that, in the event of a stress-related compressor impeller failure, the shaft will be contained in its proper placement within the turbocharger.

13 Claims, 3 Drawing Sheets

COMPRESSOR IMPELLER WITH STRESS RISER

RELATION TO COPENDING PATENT APPLICATION

This patent application claims priority of U.S. provisional patent application No. 60/400,015 that was filed on Jul. 30, 2002.

FIELD OF THE INVENTION

The present invention relates generally to the field of turbochargers and, more particularly, to compressor impeller design that is specifically configured to provide a desired compressor impeller failure mechanism to prevent further damage to the turbocharger in the event of a compressor impeller failure.

BACKGROUND OF THE INVENTION

Turbochargers for gasoline and diesel internal combustion engines are known devices in the art for pressurizing or boosting the intake air stream, routed to a combustion chamber of the engine, by using the heat and volumetric flow of exhaust gas exiting the engine. Specifically, the exhaust gas exiting the engine is routed into a turbine housing of a turbocharger in a manner that causes an exhaust gas-driven turbine to spin within the housing.

The exhaust gas-driven turbine is mounted onto one end of a shaft that is common to a radial air compressor impeller mounted onto an opposite end of the shaft. Thus, rotary action of the turbine also causes the air compressor impeller to spin within a compressor housing of the turbocharger that is separate from the turbine housing. The spinning action of the air compressor impeller causes intake air to enter the compressor housing and be pressurized or boosted a desired amount before it is mixed with fuel and combusted within the engine combustion chamber.

It is known to attach both the compressor impeller and the turbine wheel onto a common shaft by boring holes through the compressor impeller and the turbine wheel. The common shaft is extended through the bores. Fasteners are attached to the outside ends of the common shaft to prevent the compressor impeller and the turbine wheel from traveling off of the common shaft.

It is also known to attach both the compressor impeller and turbine wheel to respective ends of the common shaft without boring holes through the compressor impeller and the turbine wheel. In such "boreless" turbocharger design, the compressor impeller and the turbine wheel are configured having partial bores disposed therein that are threaded to complement and permit threaded attachment with corresponding threads on the ends of the common shaft.

A known problem with such boreless turbochargers is that oftentimes the compressor impeller is made out of aluminum and, if overspun, the aluminum-threaded area within the bore can fail. Such failure is known to occur because in conventional design, the threaded portion of the bore is the thinnest portion of the bore and, for that reason, the portion that is most prone to stripping and/or stress cracking.

Accordingly, upon failure, it is possible for the threads in the compressor impeller bore to become stripped. When this occurs, the shaft wheel assembly is no longer secured within the turbocharger and is free to come out of the turbine discharge. If the shaft wheel assembly is no longer secured, then the high inertia of the rotating assembly may create a potential hazard.

Therefore, it would be desirable to construct a compressor impeller and common shaft assembly for a boreless turbocharger configured in a manner that prevents failure, and that prevents a failed compressor impeller from coming off of the common shaft, thereby retaining the common shaft in its position within the turbocharger.

SUMMARY OF THE INVENTION

An improved compressor impeller for use within a boreless turbocharger is provided according to principles of this invention. The boreless turbocharger includes a center housing having a first axial side and a second axial side. A shaft is positioned axially through the center housing, the shaft having a first axial end and a second axial end. A turbine housing is coupled to the center housing first axial side, and a turbine wheel is disposed inside of the turbine housing and is coupled to the first axial end of the shaft.

A compressor housing is coupled the center housing second axial side, and a compressor impeller is disposed inside of the compressor housing. The compressor impeller is configured having a partial bore disposed therein with a threaded portion positioned adjacent an open end of the bore. The second axial end of the shaft includes a threaded portion that is coupled to the threaded portion of the bore. The compressor impeller is configured having a relatively greater wall thickness surrounding the threaded portion of the bore than remaining sections of the bore. The thickened portion of the bore is provided to prevent unwanted stress cracks from developing within the bore along the area of the threads.

In an example embodiment, the compressor impeller of this invention includes a bore having an enlarged diameter section that is interposed between the bore threaded section and a close end of the bore. The enlarged diameter section is intentionally designed to have a reduced wall thickness, when compared to the threaded portion of the bore, for the purpose of creating a stress riser within the bore. This stress riser operates in a sacrificial manner to receive any unwanted stress within the bore so that, in the event that such stress was incurred, it would cause preferential shearing off of the compressor impeller at a point removed from the threaded portion of the bore, thereby operating to leave the threaded portion of the compressor impeller coupled to the shaft.

In another example embodiment, the compressor impeller of this invention is configured having an outside diameter disposed concentrically around the bore that has a reduced diameter section, thereby operating to provide a reduced wall thickness section of the bore. As the above embodiment, the reduced wall thickness section is provided at a position within the bore between the threaded portion and the closed end, to provide the same type of preferential shearing of the compressor impeller under high-stress operating conditions.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION OF THE INVENTION

Compressor impellers, constructed according to principles of this invention, are configured for use in a boreless turbocharger and are generally configured comprising a bore having a reduced wall thickness section located between a threaded portion and a closed end of the bore, and a relatively increased wall thickness section located along the threaded portion. Configured in this manner, the compressor impeller operates to ensure that the common shaft stay attached to a portion of the compressor impeller, in the event that the compressor impeller is sheared away from the shaft, thereby operating to retain the common shaft in its proper position within the turbocharger.

Figure 1:
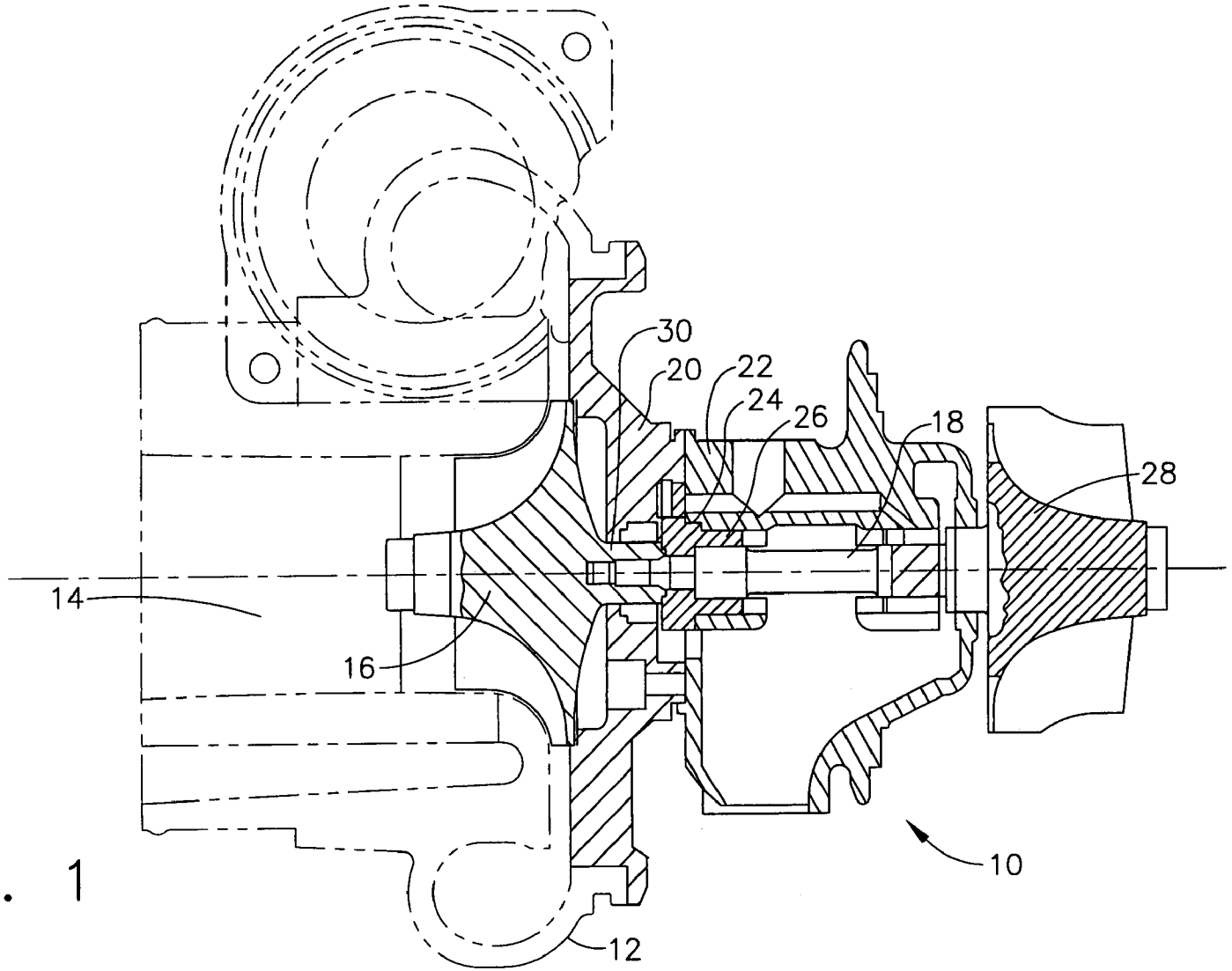
FIG. 1 is a cross-sectional view of a boreless turbocharger comprising a compressor impeller constructed according to principles of this invention.

Referring to FIG. 1, and moving from left to right, a turbocharger 10 has a compressor housing 12 that is adapted to receive air from an air intake 14, and distribute the received air to a compressor impeller 16 that is rotatably disposed within the compressor housing 12. The compressor impeller 16 is coupled to a first end of a common shaft 18.

A backplate 20 is interposed between the compressor housing 12 at one end, and to a center housing 22 at another end. The common shaft 18 passes through a thrust collar 24 disposed between the compressor impeller and the center housing 22, and extends through a bearing assembly 26 that is located inside of the center housing 22.

The center housing is coupled, at a side opposite the compressor housing, to a turbine housing (not shown). The turbine housing is adapted to receive exhaust gas from an internal combustion engine and distribute the exhaust gas to an exhaust gas turbine wheel or turbine 28 that is rotatably disposed within the turbine housing. The turbine wheel is coupled to a second end of the common shaft 18.

The compressor impeller 16 has a relatively narrow outer diameter at an end extending farthest into the air intake 14. The outer diameter of the compressor impeller then increases gradually to a maximum outer diameter at a point adjacent to the backplate. The compressor impeller 16 includes a plurality of blades that are oriented to compress or pressurize intake air by rotational movement. From the maximum outer diameter dimension, the compressor impeller outer diameter narrows quickly to a compressor impeller hub 30 which projects axially away from the impeller and that passes axially through the backplate. The compressor impeller hub terminates in an end that rests against the thrust collar 24.

Figure 2:
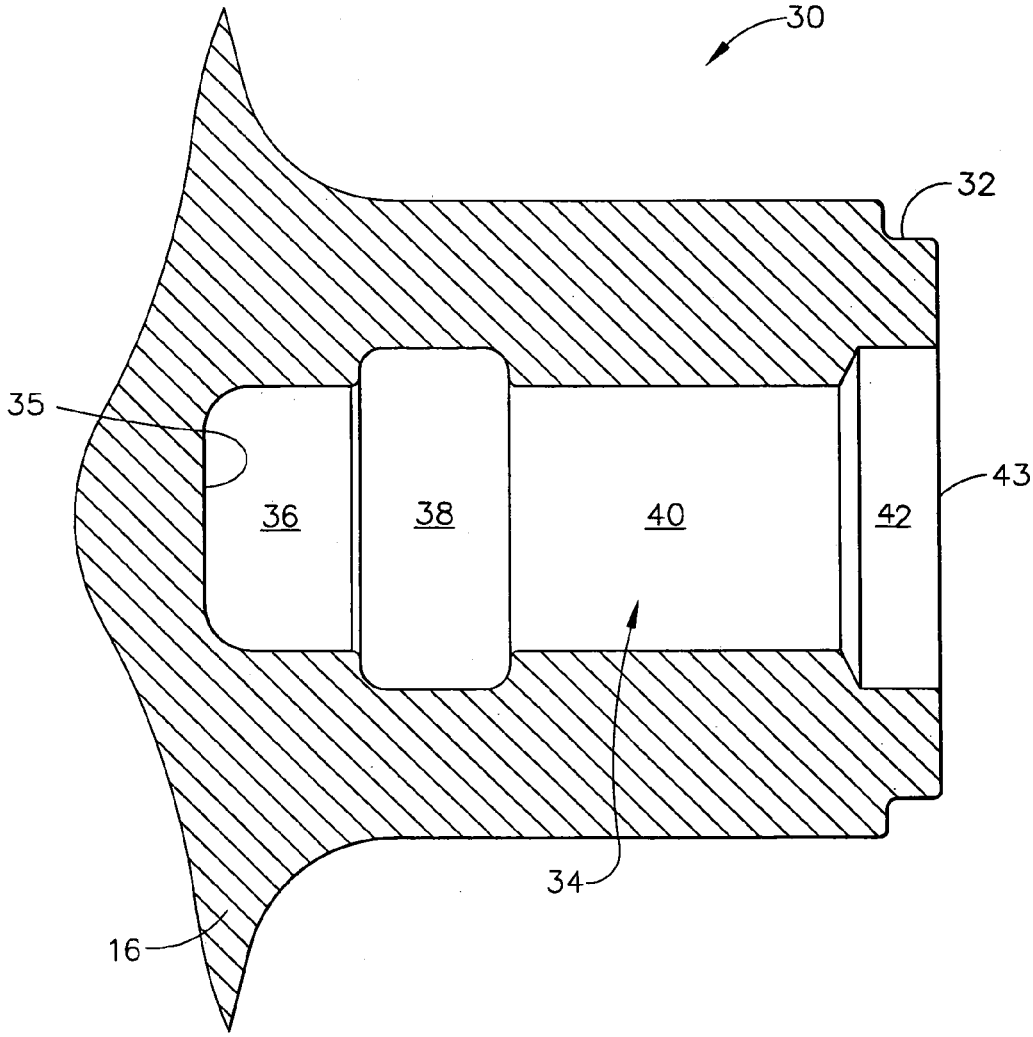
FIG. 2 is a cross sectional view of a first embodiment compressor impeller of this invention.

FIG. 2 illustrates a first embodiment compressor impeller hub 30 of this invention that is configured having a generally uniform outer diameter along its axial length. The hub 30 includes a groove 32 disposed circumferentially along an outside surface adjacent the hub end that is placed against the thrust collar 24. The groove 32 has an outside diameter that is smaller than that of the remaining portion of the compressor impeller hub. The compressor impeller hub contains a bore 34 that is disposed therein for accommodating insertion of an end of the common shaft. The bore includes a threaded portion 40 for providing a threaded connection with the common shaft, thereby attaching the compressor impeller to the shaft.

Considering the bore 34 inside of the compressor impeller hub in more detail, from left to right, the bore includes a first closed end 35, and a first diameter section 36 extending axially a distance therefrom. Moving to the right, a distance from the first diameter section, the bore includes an enlarged diameter section 38 having a diameter that is larger than that of the first diameter section.

The threaded portion 40 extends axially a distance from the enlarged diameter section 38 and has a diameter that is less than that of the enlarged diameter section 38. In an example embodiment, the threaded portion 40 has a diameter that is slightly larger than that of the first diameter section 36. Moving axially away from the threaded portion 40, the bore 34 includes a second enlarged diameter section 42 that is positioned adjacent an open end 43 of the bore. In this first embodiment compressor impeller, the hub 30 has a constant diameter outside axially projecting surface.

In an example embodiment, that is sized for use with a particular boreless turbocharger, the first embodiment compressor impeller of this invention comprises a hub having an outside surface diameter of approximately 31 mm, a bore depth of approximately 33 mm, and a bore characterized by having a first diameter section 36 of approximately 12 mm and 7 mm in length, a enlarged diameter section 38 of approximately 16 mm and 8 mm in length, a threaded portion 40 of approximately 14 mm in diameter and 15 mm in length, and a second enlarged diameter section 42 of approximately 17 mm and 3 mm in length.

Configured in this manner, the first embodiment compressor impeller hub 30 is intentionally designed having a bore with a relatively larger wall thickness along the treaded portion for the purpose of reducing and/or eliminating the possibility of stress related events causing threaded disengagement between the compressor impeller and shaft. The hub 30 is also intentionally designed having a relatively reduced wall thickness along the portion defined by the enlarged diameter section 38. The bore enlarged diameter section 38 is intentionally positioned between the threaded portion 40 and the closed end 35 of the bore to provide stress riser in the bore at a location away from the threaded connection with the shaft. This operates to increase the likelihood that any stress related failure of the compressor impeller hub will occur in the area of this engineered reduced wall thickness.

If the compressor impeller hub does experience a stress related failure at this area, the portion of the compressor impeller downstream from the shaft will shear away at this reduced wall thickness portion of the bore, thereby allowing the remaining portion of the hub 30 to retain its threaded engagement with the common shaft, and preventing the common shaft from traveling through the thrust collar 24.

Figure 3:
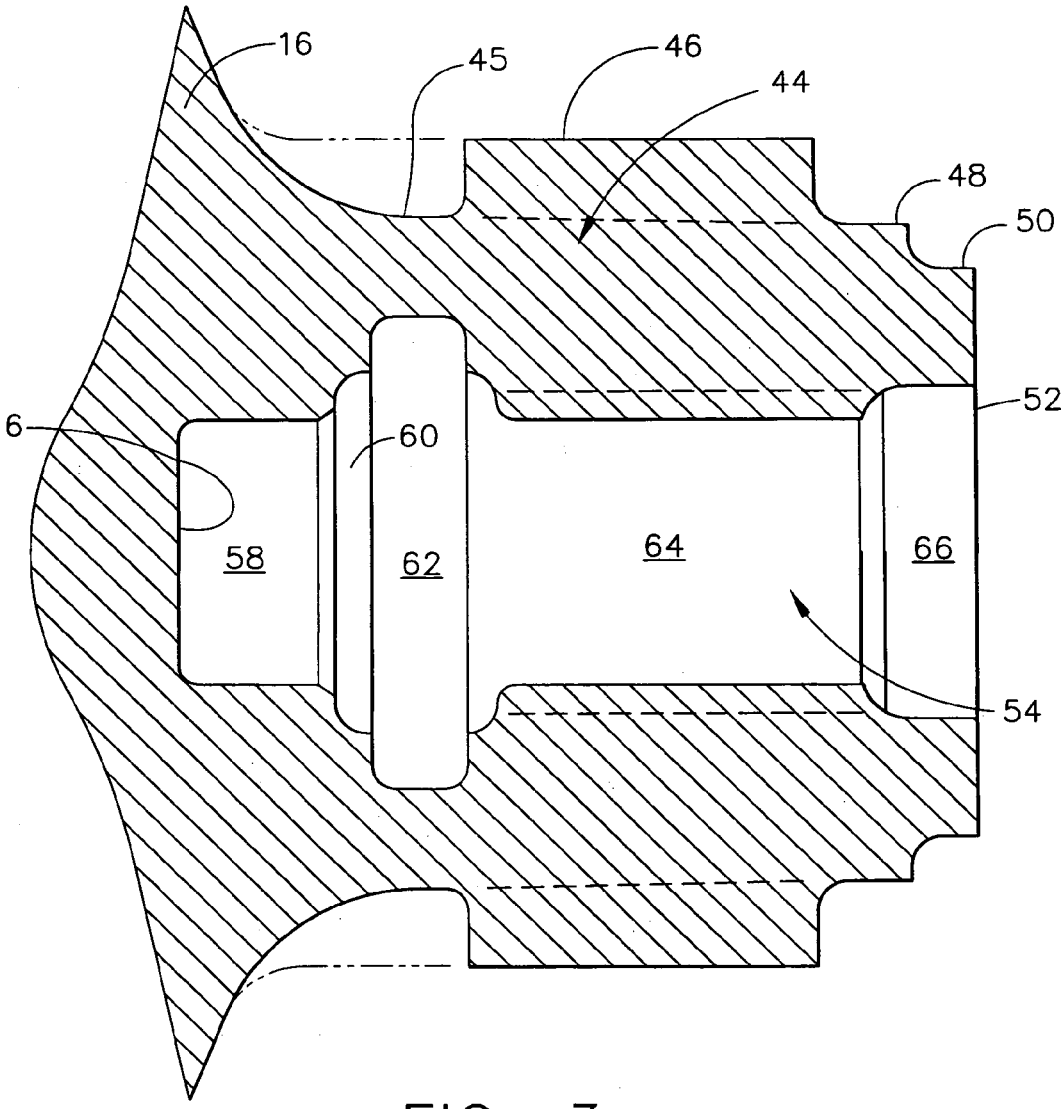
FIG. 3 is an enlarged cross sectional view of a second embodiment compressor impeller of this invention.

FIG. 3 illustrates a second embodiment compressor impeller hub 44 of this invention. In this embodiment, the compressor impeller hub 44 includes an outside diameter that, moving from left to right, tapers down from a maximum diameter to a first diameter section 45 that extends for a determined axial length. An enlarged or strengthened diameter section 46 extends a distance axially from the first diameter section 45 along the outside diameter, and is sized having a diameter that is greater than that of the first diameter section.

Moving axially away from the enlarged diameter section 46, a first reduced diameter section 48 gives away to a second reduced diameter section 50 that extends axially to a open end 52 of the hub that is positioned against the thrust collar. A groove 48 is cut into the compressor impeller hub. The second reduced diameter section 50 is sized having a diameter that is smaller than the remaining outer surface of the compressor impeller hub.

In an example embodiment, sized for use in a particular boreless turbocharger, the hub outside surface first diameter section 45 is approximately 31 mm and 4 mm in length, the enlarged diameter section 46 is approximately 38 mm and 12 mm in length, the first reduced diameter section 48 is approximately 31 mm and 4 mm in length, and the second reduced diameter section 50 is approximately 27 mm and 2 mm in length.

The second embodiment compressor impeller hub has a bore 54 that extends axially therein from a closed end 56 to the open end 52. The bore includes, moving from left to right, a first diameter section 58 that extends axially a distance from the close end 56. An enlarged diameter section 60 extends from the first diameter section 60 and is sized having a diameter that is greater than the first diameter section.

The first diameter section 60 is configured having a groove 62 disposed circumferentially therein. The groove 62 is positioned within the bore concentrically within the first diameter section 45 of the hub outside surface. The hub is intentionally configured in this manner so that the bore groove 62 and outside surface first diameter section 60 operate to provide a minimum wall thickness section in the hub to act as a stress riser, as will be described in better detail below.

Moving to the right within the bore, a threaded portion 64 extends axially a distance within the bore from the enlarged diameter section 60. The threaded portion 64 is sized having a diameter that is less than that of the enlarged diameter section 60, and is threaded to accommodate threaded attachment with a threaded end of the shaft to secure the compressor impeller thereto. The bore 54 includes a second enlarged diameter section 66 that extends axially from the threaded portion 64 to the hub open end 52.

The threaded portion 64 is intentionally positioned within the bore at a location that is concentric with the enlarged or strengthened diameter section 46 of the hub outer surface for the purpose of provided an increased wall thickness along this section and, thereby strengthening the portion of the hub that is threaded to the shaft.

Configuring the hub in this manner serves to control or eliminate the possibility of the compressor hub experiencing a sheer failure along the threaded portion of the hub, thereby ensuring that the a portion of the hub remain attached to the common shaft to prevent the shaft from traveling through the thrust collar, thereby reducing the risks often associated with failure of the compressor impeller.

The increased diameter of the second step of the bore is positioned at a point where the compressor impeller hub's outer diameter is smaller, namely between the thickened portion and the portion where the compressor impeller outer diameter decreases from its maximum. This arrangement creates an area of reduced diameter in the hub at a point beyond the thread portion. Therefore, if failure of the compressor impeller occurs, the failure will not cause the threads to break, and will not allow the common shaft to travel through the thrust collar.

In an example embodiment, sized for use in a particular boreless turbocharger, a second embodiment compressor impeller of this invention has a bore depth of approximately 33 mm, and a bore characterized by having a first diameter section 58 of approximately 12 mm and 7 mm in length, a enlarged diameter section 60 of approximately 16 mm and 7 mm in length, a groove 62 diameter of approximately 22 mm and 4 mm in length, a threaded portion 64 of approximately 14 mm in diameter and 15 mm in length, and a second enlarged diameter section 66 of approximately 17 mm and 3 mm in length.

Compressor impellers are configured, according to principles of this invention, having a hub portion that is intentionally designed to provide a preferential stress relief mechanism to direct any such related failure to a portion of the compressor impeller removed from the threaded connection with the common shaft so as to retain the shaft in its proper portion within the turbocharger. Compressor impellers of this invention are also configured to strengthen the region of the hub surrounding the threaded portion to ensure that any such stress-related failure not occur at this portion, but rather along a portion of the hub located axially away therefrom and towards an end of the hub bore. Compressor impellers of this invention can be formed from suitable high-strength materials conventionally used to form the same, by use of molding or machining techniques.

Having now described the invention in detail as required by the patent statutes, those skilled in the art will recognize modifications and substitutions to the specific embodiments disclosed herein. Such modifications are within the scope and intent of the present invention.

What is claimed is:

1. A compressor impeller for use within a turbocharger, the compressor impeller comprising a body having a number of blades projecting radially therefrom, and an integral hub projecting axially a distance away from the body, the hub having a bore that includes a threaded section to permit threaded engagement with a threaded shaft, the bore further comprising a closed end and a reduced wall thickness section positioned between the bore threaded section and the closed end, wherein the hub includes an outside surface having a reduced diameter section relative to the wall thickness of the threaded section positioned radially adjacent the reduced wall thickness section.

2. The compressor impeller as recited in claim 1 wherein the bore threaded section is positioned adjacent an opening to the bore, and the bore includes an enlarged diameter section positioned between the bore threaded section and the closed end, and a further diameter section positioned between the closed end and enlarged diameter section that is smaller than the enlarged diameter section.

3. The compressor impeller as recited in claim 1 wherein the bore reduced wall thickness section is positioned axially a distance away from the impeller blades.

4. The compressor impeller as recited in claim 1 wherein the bore threaded section is positioned adjacent an opening to the bore, and the bore includes an enlarged diameter section positioned between the bore threaded section and the closed end.

5. The compressor impeller as recited in claim 1 wherein the hub outside surface includes an enlarged diameter section that is positioned radially adjacent at least a portion of the bore threaded section.

6. A turbocharger for internal combustion engines, the turbocharger comprising:

a center housing having a first side and a second side;

a shaft positioned axially within the center housing, the shaft having a first end and a second end;

a turbine housing connected to the first side of the center housing;

a turbine wheel disposed within the turbine housing, the turbine wheel being coupled to the first end of the shaft;

a compressor housing connected to the second side of the center housing; and a compressor impeller disposed within the compressor housing, the compressor impeller including an integral hub projecting axially therefrom, the hub including a partial bore disposed therein having a threaded portion, the compressor impeller being threadably coupled along the threaded portion to the second end of the shaft;

wherein the hub bore includes a wall section that is relatively thinner than a wall thickness of the threaded portion, wherein the relatively thinner wall section is positioned axially within the bore between the threaded portion and a closed end of the bore, and wherein the hub includes an outside surface having a reduced diameter section relative to the wall thickness of the threaded section positioned axially between the bore threaded portion and the closed end.

7. The turbocharger as recited in claim 6 wherein the hub bore includes an enlarged diameter section interposed between the threaded portion and the closed end, and wherein the bore includes a diameter section extending between the enlarged diameter section and the closed end having a diameter sized smaller than the enlarged diameter section.

8. The turbocharger as recited in claim 6 wherein the hub bore includes an enlarged diameter section interposed between the threaded portion and the closed end.

9. The turbocharger as recited in claim 6 wherein the hub outside surface includes an enlarged diameter section that is positioned along at least a portion of the bore threaded section.

10. A compressor impeller for use within a turbocharger having a common shaft disposed through a center housing, and a turbine wheel attached to one end of the shaft and disposed within a turbine housing attached to the center housing, the compressor impeller being attached to an opposite end of the shaft and being disposed within a compressor housing attached to the center housing, the compressor impeller comprising an integral hub projecting axially therefrom towards the center housing, the hub including a bore extending partially therein from a bore open end to a closed end, the bore including a threaded portion for accommodating threaded attachment with the shaft, the threaded portion having a wall thickness that is greater than a portion of the bore positioned between the threaded portion and the closed end, the hub including a reduced diameter section relative to the wall thickness of the threaded section extending circumferentially around an outside surface of the hub axially positioned between the bore threaded portion and the bore closed end.

11. The compressor impeller as recited in claim 10 wherein the hub bore includes an enlarged diameter section interposed between the threaded portion and the closed end.

12. The compressor impeller as recited in claim 11 wherein the hub bore includes a further diameter section interposed between the enlarged diameter section and the closed end that has a diameter less than that of the enlarged diameter section.

13. The compressor impeller as recited in claim 10 wherein the hub outside surface includes an enlarged diameter section that is positioned along at least a portion of the bore threaded section.

* * * * *